US009332841B1

(12) United States Patent
Moulinet

(10) Patent No.: US 9,332,841 B1
(45) Date of Patent: May 10, 2016

(54) DRAWER PULL

(71) Applicant: Patricia Moulinet, Phoenix, AZ (US)

(72) Inventor: Patricia Moulinet, Phoenix, AZ (US)

( * ) Notice: Subject to any disclaimer, the term of this patent is extended or adjusted under 35 U.S.C. 154(b) by 0 days.

(21) Appl. No.: 14/854,145

(22) Filed: Sep. 15, 2015

(51) Int. Cl.
*A47B 95/02* (2006.01)
*A47B 88/04* (2006.01)
*A47B 95/04* (2006.01)

(52) U.S. Cl.
CPC ..... *A47B 95/02* (2013.01); *A47B 88/04* (2013.01); *A47B 95/04* (2013.01); *A47B 2095/024* (2013.01); *A47B 2095/028* (2013.01); *Y10T 16/462* (2015.01); *Y10T 16/4636* (2015.01); *Y10T 16/473* (2015.01)

(58) Field of Classification Search
CPC .... A47B 88/04; A47B 88/0044; A47B 95/02; A47B 95/04; A47B 95/043; A47B 2095/024; A47B 2095/028; A47B 2095/46; A47B 2220/0047; Y10T 16/462; Y10T 16/417; Y10T 16/473; Y10T 16/498; Y10T 16/4636; Y10T 16/469; Y10T 16/506
See application file for complete search history.

(56) References Cited

U.S. PATENT DOCUMENTS

| | | | | |
|---|---|---|---|---|
| D167,151 | S | 7/1952 | Koch | |
| 2,642,581 | A * | 6/1953 | Loe | A47K 3/003 16/422 |
| 2,771,627 | A | 11/1956 | Hammer | |
| D253,031 | S | 10/1979 | Gidseg | |
| 4,379,603 | A | 4/1983 | Johnson | |
| 4,817,239 | A | 4/1989 | Campbell | |
| 5,618,091 | A * | 4/1997 | Huber | A47B 88/0014 312/265.5 |
| D384,571 | S | 10/1997 | Edwards | |
| 7,040,726 | B2 | 5/2006 | Steffee | |
| D595,560 | S | 7/2009 | Miska | |
| 8,365,360 | B2 | 2/2013 | Kunnath | |
| D690,186 | S | 9/2013 | Coffin | |
| 2008/0296866 | A1 * | 12/2008 | Martin | B62B 5/06 280/304.5 |
| 2014/0033498 | A1 * | 2/2014 | Coffin | A47B 95/02 29/428 |

FOREIGN PATENT DOCUMENTS

| | | | | |
|---|---|---|---|---|
| CN | 201223147 Y | 4/2009 | | |
| FR | 2254935 A5 * | 7/1975 | | A47B 47/00 |

* cited by examiner

*Primary Examiner* — Andrew Roersma
(74) *Attorney, Agent, or Firm* — Kyle A. Fletcher, Esq.

(57) ABSTRACT

The drawer pull is a device that is adapted for use with a drawer face in order to provide a pull that is used to open or close off the respective drawer. The drawer pull is adapted to be installed onto an existing drawer, but with no retrofitting required of the drawer or the drawer face. The drawer pull includes a knob that extends forwardly of a planar member. The planar member may be decorative, and is telescopically affixed to a frame member. The planar member includes a pair of armatures that extend rearwardly. The pair of armatures is telescopically engaged with respect to the frame member. Moreover, the pair of armatures enables the planar member and the knob to adjust with respect to the frame member in order to adaptively accommodate a drawer front of a drawer.

16 Claims, 3 Drawing Sheets

DRAWER PULL

CROSS REFERENCES TO RELATED APPLICATIONS

Not applicable

STATEMENT REGARDING FEDERALLY SPONSORED RESEARCH

Not applicable

REFERENCE TO APPENDIX

Not applicable

BACKGROUND OF THE INVENTION

Field of the Invention

The present invention relates to the field of drawer and cabinet hardware, more specifically, a drawer pull that is adapted to attach onto a drawer.

SUMMARY OF INVENTION

The drawer pull is a device that is adapted for use with a drawer face in order to provide a pull that is used to open or close off the respective drawer. The drawer pull is adapted to be installed onto an existing drawer, but with no retrofitting required of the drawer or the drawer face. The drawer pull includes a knob that extends forwardly of a planar member. The planar member may be decorative, and is telescopically affixed to a frame member. The planar member includes a pair of armatures that extend rearwardly. The pair of armatures is telescopically engaged with respect to the frame member. Moreover, the pair of armatures enables the planar member and the knob to adjust with respect to the frame member in order to adaptively accommodate a drawer front of a drawer.

It is an object of the invention to provide a device that is able to work with a drawer front in order to provide a drawer pull that requires no drilling or retrofitting of the drawer front.

This together with additional objects, features, and advantages of the drawer pull will be readily apparent to those of ordinary skill in the art upon reading the following detailed description of the presently preferred, but nonetheless illustrative, embodiments when taken in conjunction with the accompanying drawings.

In this respect, before explaining the current embodiments of the drawer pull in detail, it is to be understood that the drawer pull is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rotatable snowboard binding.

It is therefore important that the claims be regarded as including such equivalent construction insofar as they do not depart from the spirit and scope of the drawer pull. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
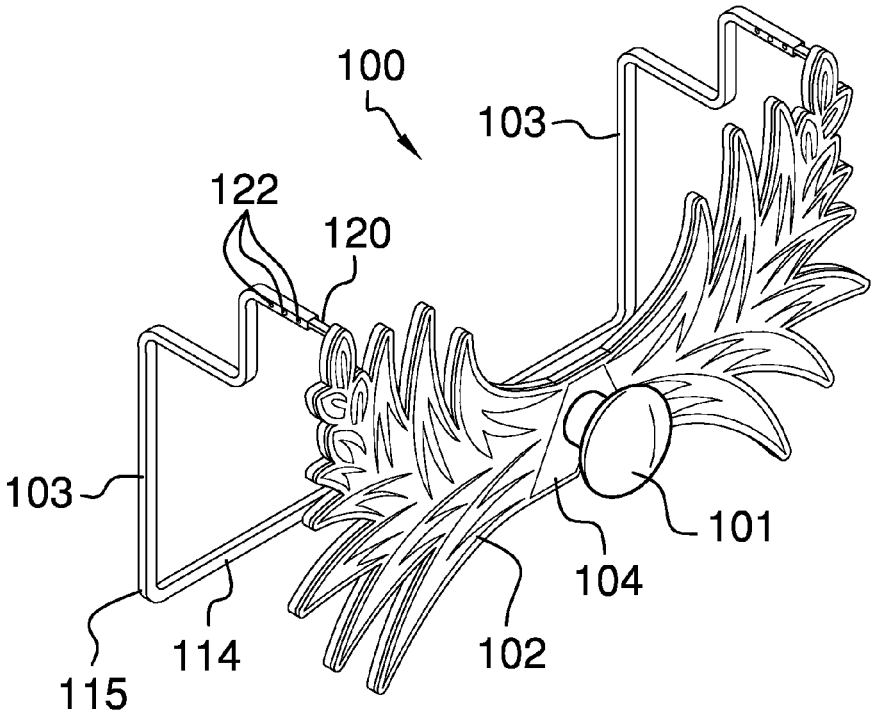
FIG. 1 is a perspective view of an embodiment of the disclosure.
Figure 2:
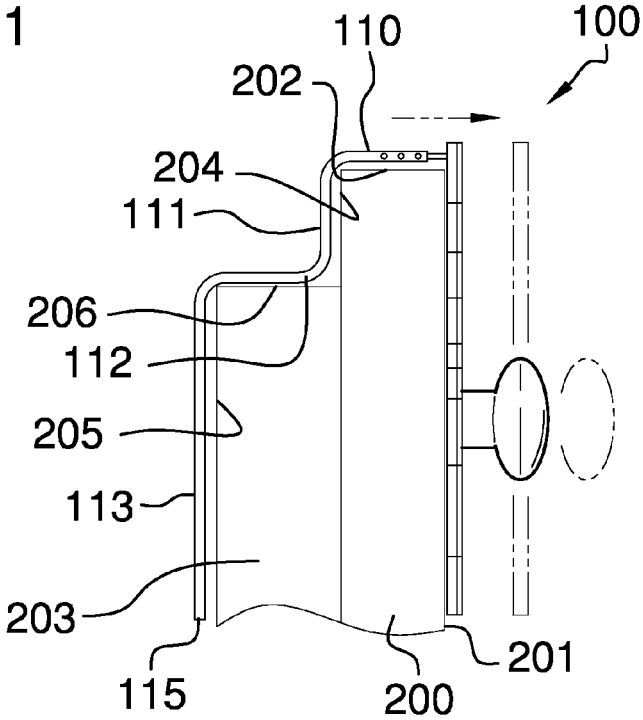
FIG. 2 is a side view of an embodiment of the disclosure.
Figure 3:
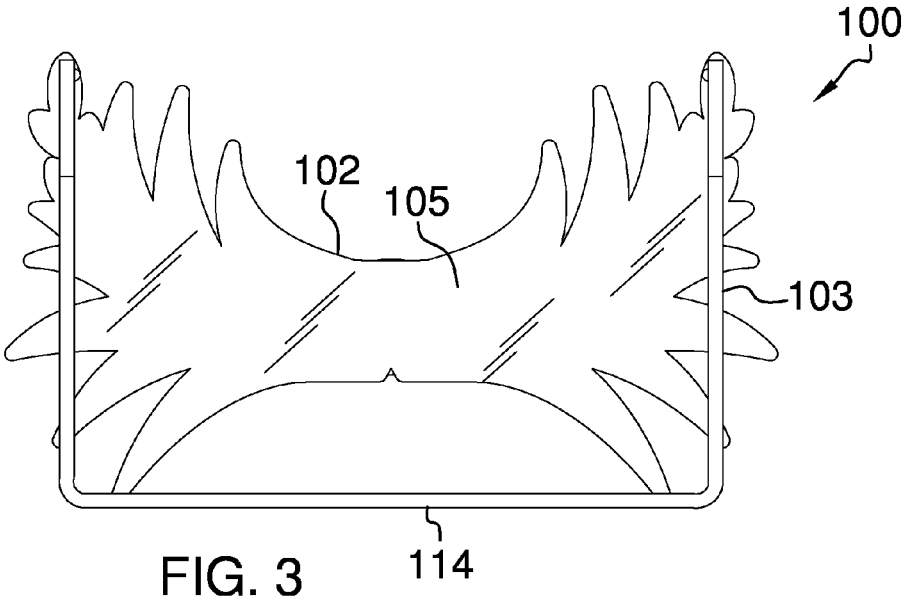
FIG. 3 is a rear view of an embodiment of the disclosure.
Figure 4:
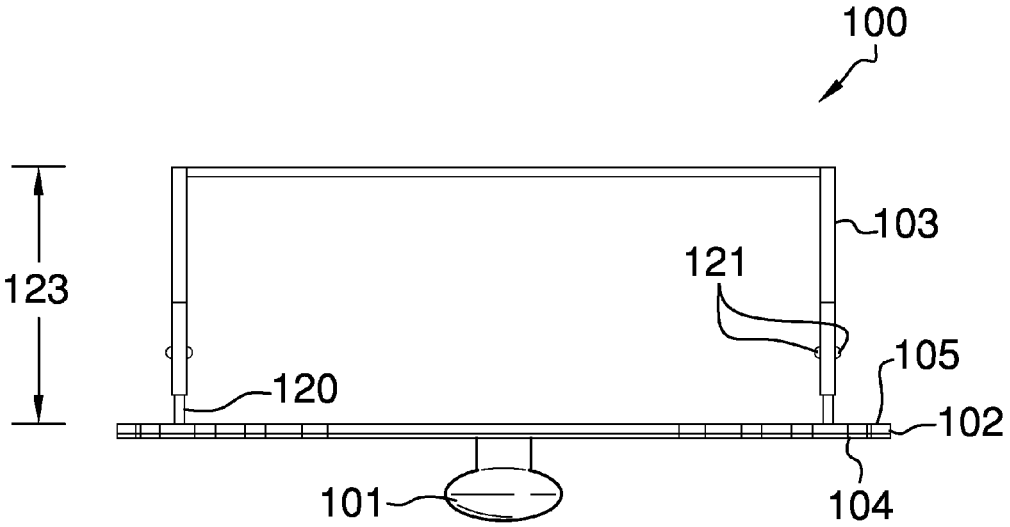
FIG. 4 is a top view of an embodiment of the disclosure.
Figure 5:
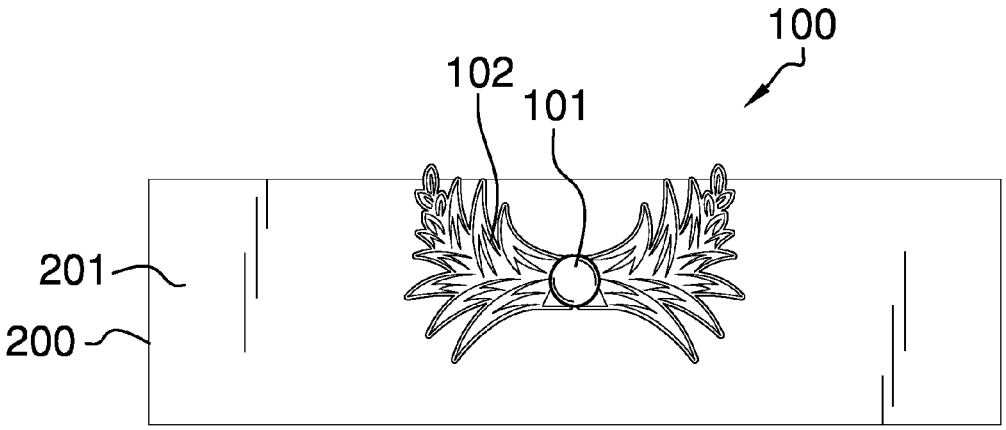
FIG. 5 is a front view of an embodiment of the disclosure in use.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6, in the form of the drawer pull 100 (hereinafter invention) includes a knob 101, a planar member 102, and a frame 103. The invention 100 is adapted for use with a drawer face 200 in order to provide a drawer pull that requires no drilling or retrofitting of the drawer face 200.

The knob 101 projects outwardly from the planar member 102 as well as the drawer face 200. The planar member 102 may be decorative in shape, and is further defined with a front surface 104. The knob 101 is affixed to and extends outwardly from the front surface 104 of the planar member 102. The planar member 102 is further defined with a rear surface 105 that is adapted to interface with a front drawer face surface 201 of the drawer face 200.

The frame 103 is adapted to encounter a first top surface 202 of the drawer face 200 as well as a drawer 203. The drawer 203 is rigidly affixed to the drawer face 200. The invention 100 is adapted to move the drawer face 200 and the drawer 203 via the knob 101. The drawer 203 is positioned behind the drawer face 200. The drawer face 200 is further defined with a first rear surface 204. The drawer 203 is further defined with a second rear surface 205. The first rear surface 204 is parallel with the second rear surface 205.

The frame 103 is adapted to interface with the first top surface 202 and the first rear surface 204 of the drawer face 202. Moreover, the frame 103 is adapted to interface with a second top surface 206 as well as the second rear surface 205 of the drawer 203. The frame 103 is further defined with a first horizontal portion 110, a first vertical portion 111, a second horizontal portion 112, and a second vertical portion 113. The first horizontal portion 110 is defined with a pair of first horizontal portions 110. The first vertical portion 111 is defined as a pair of first vertical portions 111. The second horizontal portion 112 is defined as a pair of second horizontal portions 112. The second vertical portion 113 is defined as a pair of second vertical portions 113. A lateral member 114 extends across a distal end 115 of the pair of second vertical portions 113.

In use, the frame 103 is adapted to interface with the drawer face 200 and the drawer 203. Moreover, the pair of first horizontal portions 110 adaptively interface with the first top surface 202 of the drawer face 200. The pair of first vertical portions 111 adaptively interface with the first rear surface 204 of the drawer face 200. The pair of second horizontal portions 112 adaptively interface with the second top surface 206 of the drawer 203. The pair of second vertical portions 113 adaptively interface the second rear surface 205 of the drawer 203.

The frame 103 is responsible for securing the planar member 102 to the drawer face 200. The planar member 102 is further defined with a pair of armatures 120 that extend rearwardly of the rear surface 105 of the planar member 102. The pair of armatures 120 is telescopically engaged with respect to the frame 103. Moreover, the pair of armatures 120 is telescopically engaged with respect to the pair of first horizontal portions 110. The pair of armatures 120 slide within the pair of first horizontal portions 110. Each of the pair of armatures 120 includes at least one spring-loaded button 121 that engages one of a plurality of holes 122 provided on the pair of first horizontal portions 110. The pair of armatures 120 enable the planar member 102 to extend or retract a depth 123 formed between the rear surface 105 of the planar member 102 and the lateral member 114 of the frame 103.

Figure 6:
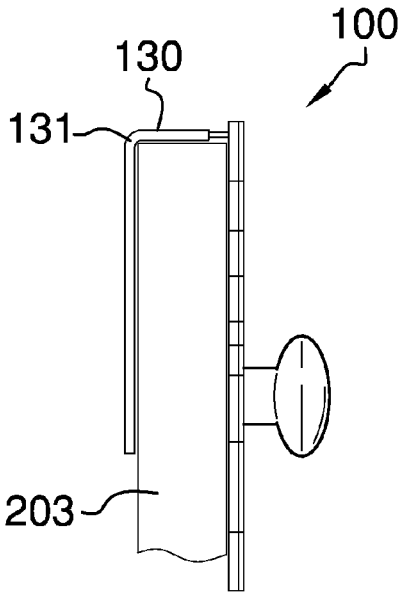
FIG. 6 is a side view of an alternative embodiment of the disclosure in use.

Referring to FIG. 6, the invention 100 may involve an alternative embodiment that accommodates the drawer 203 directly. In FIG. 6, the drawer 203 does not affix to a drawer face 200, thereby necessitating a second frame 130 that is more simplistic. The second frame 130 includes a first bend 131.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A drawer pull comprising:

a knob affixed to a planar member;

wherein a frame extends rearwardly of the planar member;

wherein the planar member and the frame extend across a drawer in order to enable the knob to be secured there against;

wherein the knob is adapted to be grasped in order to pull open or close said drawer wherein the planar member is further defined with a rear surface that is adapted to interface with a front drawer face surface of a drawer face; wherein the frame is adapted to interface with a first top surface of the drawer face as well as the drawer; wherein the drawer is rigidly affixed to the drawer face; wherein the drawer is positioned behind the drawer face; wherein the drawer face is further defined with a first rear surface; wherein the drawer is further defined with a second rear surface; wherein the first rear surface is parallel with the second rear surface; and wherein the frame is adapted to simultaneously interface with the first top surface of the drawer face, the first rear surface of the drawer face, a second top surface of the drawer, and the second rear surface of the drawer.

2. The drawer pull according to claim 1 wherein the knob projects outwardly from the planar member.

3. The drawer pull according to claim 2 wherein the planar member is further defined with a front surface.

4. The drawer pull according to claim 3 wherein the knob is affixed to and extends outwardly from the front surface of the planar member.

5. The drawer pull according to claim 4 wherein the frame is further defined with a first horizontal portion, a first vertical portion, a second horizontal portion, and a second vertical portion.

6. The drawer pull according to claim 5 wherein the first horizontal portion is defined with a pair of first horizontal portions; wherein the first vertical portion is defined as a pair of first vertical portions; wherein the second horizontal portion is defined as a pair of second horizontal portions; wherein the second vertical portion is defined as a pair of second vertical portions.

7. The drawer pull according to claim 6 wherein a lateral member extends across a distal end of the pair of second vertical portions.

8. The drawer pull according to claim 7 wherein the frame is adapted to interface with the drawer face and the drawer.

9. The drawer pull according to claim 8 wherein the pair of first horizontal portions adaptively interface with the first top surface of the drawer face.

10. The drawer pull according to claim 9 wherein the pair of first vertical portions adaptively interface with the first rear surface of the drawer face.

11. The drawer pull according to claim 10 wherein the pair of second horizontal portions adaptively interface with the second top surface of the drawer.

12. The drawer pull according to claim 11 wherein the pair of second vertical portions adaptively interface the second rear surface of the drawer.

13. The drawer pull according to claim 12 wherein the planar member is further defined with a pair of armatures that extend rearwardly of the rear surface of the planar member.

14. The drawer pull according to claim 13 wherein the pair of armatures is telescopically engaged with respect to the frame.

15. The drawer pull according to claim 14 wherein the pair of armatures is telescopically engaged with respect to the pair of first horizontal portions; wherein the pair of armatures slide within the pair of first horizontal portions.

16. The drawer pull according to claim 15 wherein each of the pair of armatures includes at least one spring-loaded button that engages one of a plurality of holes provided on the pair of first horizontal portions; wherein the pair of armatures enable the planar member to extend or retract a depth formed between the rear surface of the planar member and the lateral member of the frame.

* * * * *